US006188878B1

(12) United States Patent
Iwashita et al.

(10) Patent No.: US 6,188,878 B1
(45) Date of Patent: Feb. 13, 2001

(54) RECEIVER FOR RECEIVING TEXT-BASED MULTIPLEX BROADCAST

(75) Inventors: Naoki Iwashita, Tokyo; Masami Yanagibori, Chiba, both of (JP)

(73) Assignee: Sony Corporation, Tokyo (JP)

( * ) Notice: Under 35 U.S.C. 154(b), the term of this patent shall be extended for 0 days.

(21) Appl. No.: 09/049,085

(22) Filed: Mar. 27, 1998

(30) Foreign Application Priority Data

Apr. 2, 1997 (JP) ..... 9-083479

(51) Int. Cl.[7] ..... H04H 1/04
(52) U.S. Cl. ..... 455/158.4; 455/186.1
(58) Field of Search ..... 370/487, 486; 455/158.4, 186.2, 186.1, 458, 412, 45, 566; 345/203, 508, 511, 512, 507, 509

(56) References Cited

U.S. PATENT DOCUMENTS 5,733,131 * 3/1998 Park ..... 455/38.1
5,867,776 * 2/1999 Noda ..... 455/186.1
5,956,628 * 9/1999 Owaki ..... 370/486

* cited by examiner

*Primary Examiner*—Wellington Chin
*Assistant Examiner*—Prenell Jones
(74) *Attorney, Agent, or Firm*—Jay H. Maioli

(57) ABSTRACT

An FM receiver for receiving a text-based multiplex broadcast includes a decoder for taking out text-based program data from a multiplexed signal received at a receiver circuit and a controller having first and second memory areas. Data taken out by the decoder is alternately written to the first and second memory areas each time a power supply is turned on. When the power supply is turned on, the controller reads out data from one of the first and second memory areas that is carrying out writing of the data, and displays a text-based program at a display element with this read-out data. The memory area carrying out the reading of data is then alternately changed over between the first and second memory areas upon the operation of a prescribed key.

2 Claims, 7 Drawing Sheets

FIG.2A

DSP

FIG.2B

FM-CAV MIERURAJIO MAINMENU
1. PROGRAM INFORMATION
2. NEWS & SPORTS

DSP

FIG.2C

FM-CAV MIERURAJIO MAINMENU
3. WEATHER FORECAST
4. TRAFIC INFORMATION

DSP

FIG.2D

FM-CAV MIERURAJIO WEATHER FORECAST
1. WEATHER IN TOKYO AREA
2. WEATHER IN KANAGAWA AREA

DSP

FIG.2E

FM-CAV MIERURAJIO WEATHER FORECAST
〈KANAGAWA AREA〉 (TODAY)
FAIR IT WILL CLOUDY AFTER

DSP

FIG.2F

FM-CAV MIERURAJIO WEATHER FORECAST
PROBABILTY OF RAIN
10%

DSP

FIG.2G

FM-CAV MIERURAJIO WEATHER FORECAST
〈KANAGAWA AREA〉 (TOMORROW)
FAIR

DSP

FIG.2H

FM-CAV MIERURAJIO WEATHER FORECAST
PROBABILTY OF RAIN
0%

DSP

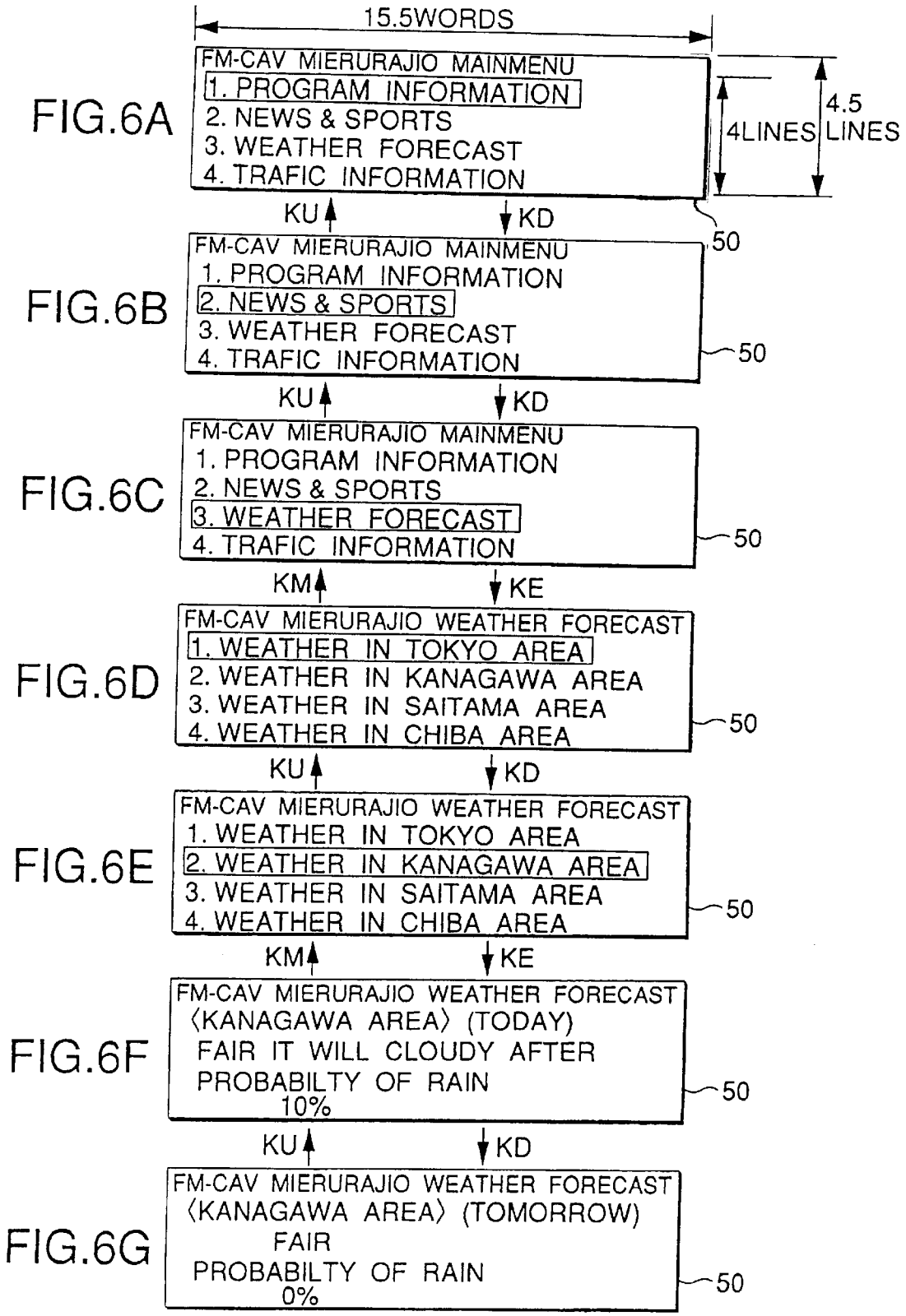
15.5WORDS
FIG.6A
FM-CAV MIERURAJIO MAINMENU
1. PROGRAM INFORMATION
2. NEWS & SPORTS
3. WEATHER FORECAST
4. TRAFIC INFORMATION
4LINES
4.5 LINES
50
KU
KD
FIG.6B
FM-CAV MIERURAJIO MAINMENU
1. PROGRAM INFORMATION
2. NEWS & SPORTS
3. WEATHER FORECAST
4. TRAFIC INFORMATION
50
KU
KD
FIG.6C
FM-CAV MIERURAJIO MAINMENU
1. PROGRAM INFORMATION
2. NEWS & SPORTS
3. WEATHER FORECAST
4. TRAFIC INFORMATION
50
KM
KE
FIG.6D
FM-CAV MIERURAJIO WEATHER FORECAST
1. WEATHER IN TOKYO AREA
2. WEATHER IN KANAGAWA AREA
3. WEATHER IN SAITAMA AREA
4. WEATHER IN CHIBA AREA
50
KU
KD
FIG.6E
FM-CAV MIERURAJIO WEATHER FORECAST
1. WEATHER IN TOKYO AREA
2. WEATHER IN KANAGAWA AREA
3. WEATHER IN SAITAMA AREA
4. WEATHER IN CHIBA AREA
50
KM
KE
FIG.6F
FM-CAV MIERURAJIO WEATHER FORECAST
〈KANAGAWA AREA〉 (TODAY)
FAIR IT WILL CLOUDY AFTER
PROBABILTY OF RAIN
10%
50
KU
KD
FIG.6G
FM-CAV MIERURAJIO WEATHER FORECAST
〈KANAGAWA AREA〉 (TOMORROW)
FAIR
PROBABILTY OF RAIN
0%
50

FIG.7A

FM-CAV MIERURAJIO MAINMENU
1. PROGRAM INFORMATION
2. NEWS & SPORTS
3. WEATHER FORECAST
4. TRAFIC INFORMATION

50

KU ↑ ↓ KD

FIG.7B

FM-CAV MIERURAJIO MAINMENU
1. PROGRAM INFORMATION
2. NEWS & SPORTS
3. WEATHER FORECAST
4. TRAFIC INFORMATION

50

KU ↑ ↓ KD

FIG.7C

FM-CAV MIERURAJIO MAINMENU
1. PROGRAM INFORMATION
2. NEWS & SPORTS
3. WEATHER FORECAST
4. TRAFIC INFORMATION

50

KM ↑ ↓ KE

FIG.7D

FM-CAV MIERURAJIO WEATHER FORECAST
1. WEATHER IN TOKYO AREA
2. WEATHER IN KANAGAWA AREA
3. WEATHER IN SAITAMA AREA
4. WEATHER IN CHIBA AREA

50

KU ↑ ↓ KD

FIG.7E

FM-CAV MIERURAJIO WEATHER FORECAST
1. WEATHER IN TOKYO AREA
2. WEATHER IN KANAGAWA AREA
3. WEATHER IN SAITAMA AREA
4. WEATHER IN CHIBA AREA

50

KM ↑ ↓ KE

FIG.7F

FM-CAV MIERURAJIO WEATHER FORECAST
〈KANAGAWA AREA〉 (TODAY)
FAIR IT WILL CLOUDY AFTER
PROBABILTY OF RAIN
10%

50

KU ↑ ↓ KD

FIG.7G

FM-CAV MIERURAJIO WEATHER FORECAST
〈KANAGAWA AREA〉 (TOMORROW)
FAIR
PROBABILTY OF RAIN
0%

50

RECEIVER FOR RECEIVING TEXT-BASED MULTIPLEX BROADCAST

BACKGROUND OF THE INVENTION

1. Field of the Invention

The present invention relates to a receiver for receiving a text-based multiplex broadcast.

2. Description of Related Art

In an FM broadcast, for example, within Japan, a transmission referred to as "FM text-based multiplex broadcasting" has been put to practical use for which digital data such as character information is frequency-multiplexed with an original audio broadcast program and transmitted.

This FM text-based multiplex broadcasting system is referred to as the "DARC (Data Radio Channel) system" developed under the leading of the NHK (Nippon Hoso Kyokai: Japan Broadcasting Corporation) Science and Technical Laboratories, and the standard for multiplexing digital data such as character information is:

sub-carrier frequency: 76 kHz transmission rate: 16 bit/second modulation system: LMSK (Level controlled Minimum Shift Keying)

error correction method: (272,190) product code with compacted cyclic code of difference set This LMSK signal is then frequency-multiplexed with an audio signal (monaural signal or stereo composite signal) for the original audio broadcast program and this frequency-multiplexed signal is then transmitted.

Program services such as those of character information are classified into levels 1, 2 and 3, with character information being displayed with dots in all of them. A level 1 program service is, as shown in FIG. 1A, a service for an FM receiver capable of displaying 15.5 characters X 2.5 lines including a header part, with information being given with characters. Further, one text-based program is taken to have a maximum capacity of 62 pages, with one page being made to have 15.5 characters X 2 lines.

News, weather forecasts, traffic information, entertainment and main supplementary programs are considered to be as the level 1 program services. In this case, the entertainment program is to provide information such as fortune telling, listener message boards, quizzes and town information.

The main supplementary program is provided as supplementary information for the original audio broadcast program such as a title of a musical composition, a name of artist, and a telephone and FAX number for the time of making a request when the original audio broadcast program is, for example, a music program. In the following, the main supplementary program is referred to as "program information" or "program linking".

Further, emergency information provided as the occasion calls at times of urgent necessity can also be considered as other program services.

A level 2 program service is a service for FM receivers capable of displaying 15.5 characters X 8.5 lines including the header part where the information is given as characters and figures. Further, a level 3 program service is for FM receivers capable of displaying detailed maps using media such as CD-ROMs, i.e. traffic information services for navigation systems.

[Example of Character Program Display]

An example of character program display as a level 1 program service will be explained with reference to FIG. 1A to FIG. 1H and FIG. 2A to FIG. 2H. In FIG. 2A to FIG. 2H, displays in English correspond to those in Japanese in FIG. 1A to FIG. 1H, respectively.

As shown in FIG. 1A and FIG. 2A, a display element DSP such as an LCD is provided at an FM text-based multiplex broadcast receiver suitable for the level 1 with a display region having a size for 15.5 characters X 2.5 lines (248 dots wide by 40 dots high). The region for the upper half line of this display region is made to be that for a header sentence and the region of the lower two lines is made to be a display region for a body.

When the receiver receives a text-based multiplex broadcast, the first page of the main menu is displayed at the display element as shown in FIG. 1B and FIG. 2B. If a prescribed key is operated when the first page is displayed in this way, the second page of the main menu is displayed as shown in FIG. 1C and FIG. 2C, with other pages of the main menu then being sequentially displayed thereafter in the same manner.

Programs are provided in a hierarchical manner in this main menu so that, for example, when "3. WEATHER FORECAST" is selected from the main menu shown in FIG. 1C and FIG. 2C, the sub-menus "1. WEATHER IN TOKYO AREA" and "2. WEATHER IN KANAGAWA AREA" are displayed as shown in FIG. 1D and FIG. 2D as sub-menus for one order lower programs.

Here, if one who wishes to know the weather for, for example, the Kanagawa area selects "2. WEATHER IN KANAGAWA AREA", then "<KANAGAWA AREA> (TODAY)" is displayed as the first page for the program of a lower hierarchical layer as shown in FIG. 1E and FIG. 2E. If a prescribed key is then pressed in this state, "PROBABILITY OF RAIN" for today in Kanagawa is displayed for the second page as shown in FIG. 1F and FIG. 2F. If a prescribed key is then pressed by turns as necessary, "<KANAGAWA AREA> (TOMORROW)" for the third page shown in FIG. 1G and FIG. 2G and "PROBABILITY OF RAIN" for tomorrow in Kanagawa of the fourth page shown in FIG. 1H and FIG. 2H are displayed.

Since the main menu has the programs and sub-menus that are thus provided in a hierarchical manner, the desired text-based program can be displayed by following them in order.

When data for a text-based program is received in the above described FM text-based multiplex broadcast receiver, all of the valid data is temporarily stored at a memory for a reception buffer, with the required data being read out from the saved data and the desired character data then being displayed.

Usually, data in memory is erased when the power supply is turned off, but in this case, if it is ensured that the data stored in memory is made to remain even if the power supply is turned off, thereby the data can be effectively utilized. For example, weather forecasts and traffic information can be confirmed even after the power supply is turned off.

However, if the data saved in memory in this way is turned to remain even when the power supply is made off, a problem will occur as to the time of erasing this data. Namely, the data in memory is erased by following two methods.

(1) The data is erased when, for example, 10 minutes have passed from the power supply being off. Alternatively, when the power supply is turned on after more than ten minutes have passed, this data is erased at the time of turning the power on.

(2) If new data can be received, the new data is overwritten on the old data without particularly erasing the old data when the power supply is turned on and off.

However, in the method in item (1), as there are differences in the perception of the users with respect to the data save time (the time from the power supply being turned off to the erasure of data being valid. In the above case this is 10 minutes), this cannot be said to be the most suitable method. Further, since the valid period for the data is different with, for example, general news and traffic information, the fixed save time can be meaningless.

Further, in method (2), the program being watched is old one in the period until the newest data is taken in, so that if the user mistakes this for the newest program without noticing, this information is, in a sense, incorrect. In addition, when another broadcast station is selected, the text-based program for the broadcast station having been selected before has been unconditionally erased, so that when a broadcast station for the program that one wishes to listen to is different from that for the text-based program that one wishes to watch, both wishes cannot be satisfied.

SUMMARY OF THE INVENTION

The present invention sets out to resolve the above problems.

In order to resolve the above problems, according to the present invention, a receiver for receiving a text-based multiplex broadcast for which text-based program data is multiplexed with an original audio broadcast program signal so that the multiplexed signal is broadcasted, is provided so that the receiver comprises a receiver circuit, a decoder circuit, a display element and a controller. The receiver circuit is for receiving the text-based multiplex broadcast. The decoder circuit is for taking out the text-based program data from the multiplexed signal received by the receiver circuit. The display element is for displaying the text-based program. The controller comprises the first memory area and the second memory area. Here, the data taken out by the decoder is alternately written to the first and second memories each time a power supply is turned on. The data is read out from one of the first and second memory areas that is being written with the data when the power supply is turned on. The text-based program is displayed at the display element with the read data. A memory area where reading of the data is carried out is alternately switched over between the first memory area and the second memory area upon a prescribed key operation.

Data received on the previous occasion is therefore held without being erased even when the power supply is turned on, so that when a key is operated, text-based programs can be displayed with this data.

BRIEF DESCRIPTION OF THE DRAWINGS

FIGS. 2A to 2H are views showing displays in English corresponding to those in Japanese in FIGS. 1A to 1H, respectively;

FIGS. 6A to 6G are views illustrating displays according to the present invention; and FIGS. 7A to 7G are views showing displays in English corresponding to those in Japanese in FIGS. 6A to 6G, respectively.

DETAILED DESCRIPTION OF THE PREFERRED EMBODIMENT

Figure 1A:
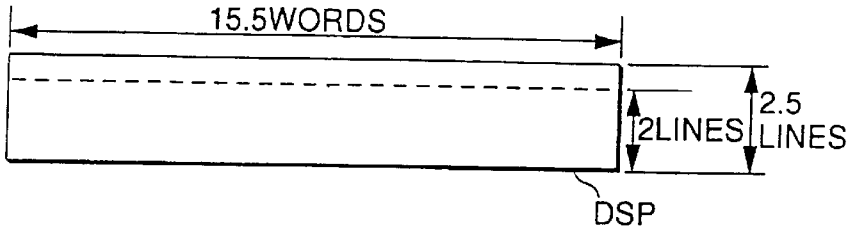
FIGS. 1A to 1H are views illustrating displays.
Figure 1B:
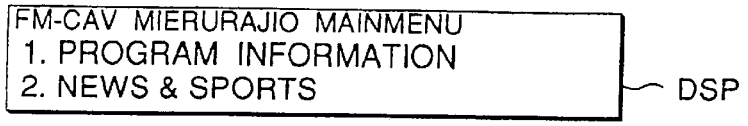
Figure 1C:
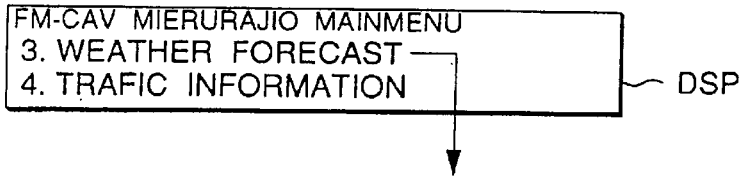
Figure 1D:
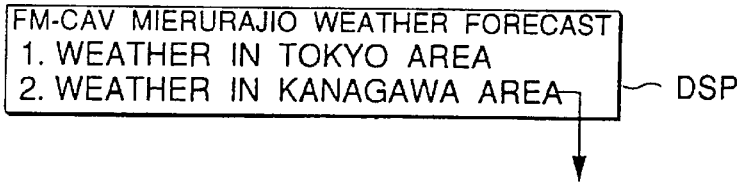
Figure 1E:
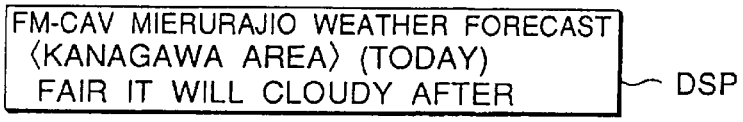
Figure 1F:
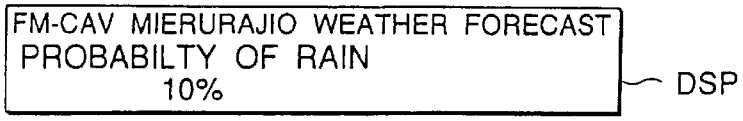
Figure 1G:
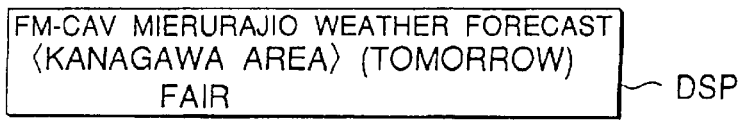
Figure 1H:
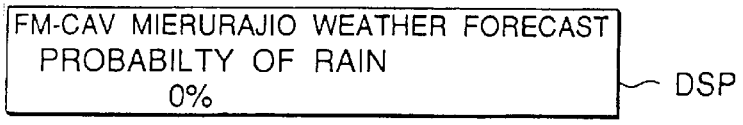
Figure 3:
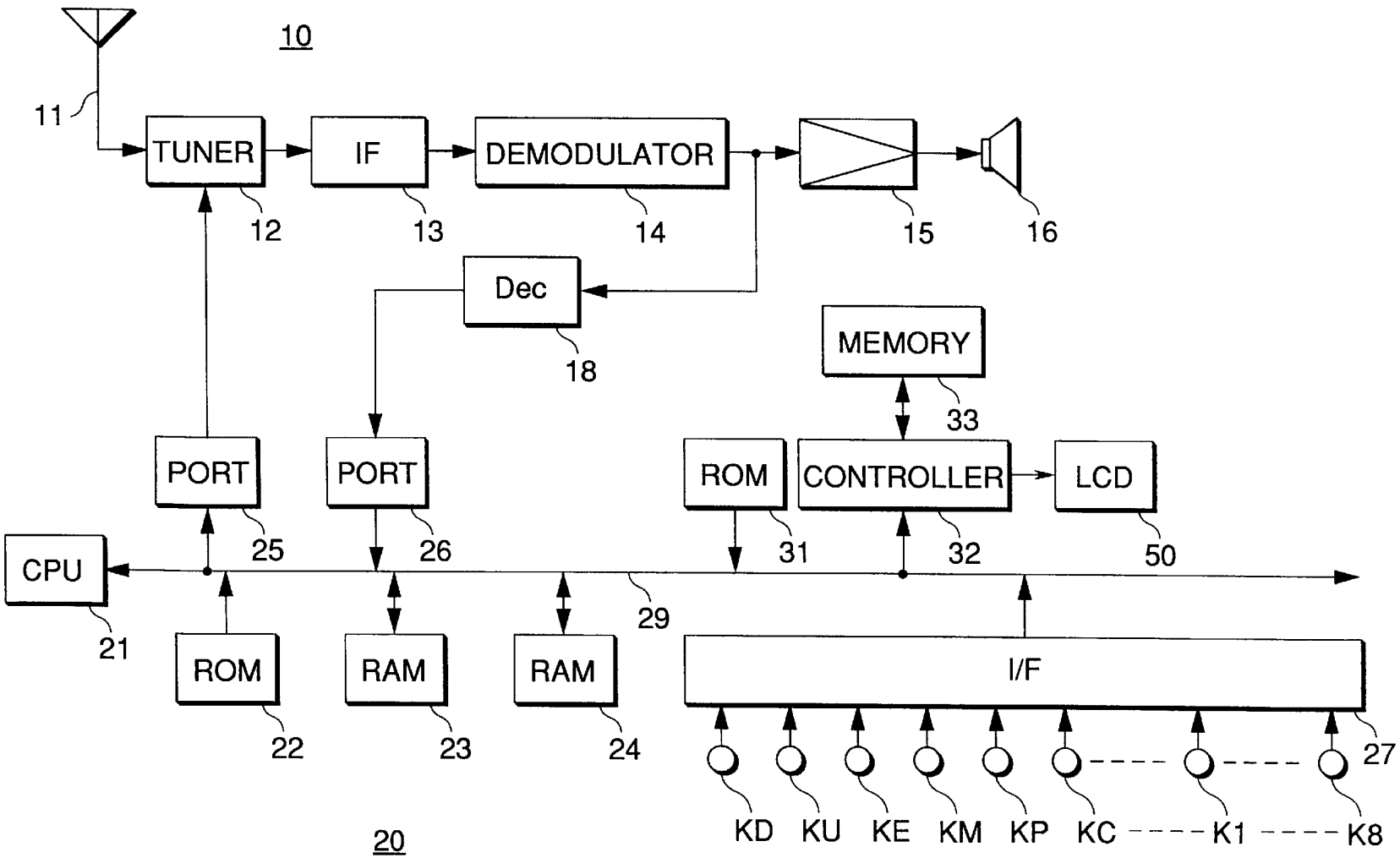
FIG. 3 is a system diagram showing an embodiment of the receiver according to the present invention.

FIG. 3 shows the case in which the invention is applied to an FM receiver with a level 1 service level. The display element of this FM receiver is capable of displaying a text-based program up to two pages, i.e. four lines, simultaneously.

In FIG. 3, numeral 10 denotes the FM text-based multiplex broadcast receiver circuit. Here, an FM signal received by an antenna 11 is supplied to a PLL synthesizer system tuner circuit 12, the broadcast station of the target frequency is selected, and the FM signal is converted to an intermediate frequency signal. This intermediate frequency signal is then supplied to an FM demodulating circuit 14 via an intermediate frequency circuit 13 having an intermediate frequency filter and amplifier. A frequency-multiplexed signal with the audio signal (monaural signal or stereo composite signal) and the LMSK signal in the aforementioned FM text-based multiplex broadcasts is then demodulated and taken out from the demodulating circuit 14.

The audio signal of this demodulated signal is then supplied to a speaker 16 via an amplifier 15. The LMSK signal of the demodulated signal of the demodulating circuit 14 is then supplied to a decoder circuit 18 and data for the text-based program is taken out from the LMSK signal with the data being decoded and error corrected.

A controller, i.e. a microcomputer 20 is further provided at this FM receiver for carrying out selection station at the tuner circuit 12 and display of characters by an FM text-based multiplex broadcast.

This microcomputer 20 comprises a CPU 21 for executing programs, a ROM 22 for programming, a RAM 23 for data area and work area and a RAM 24 for a reception buffer for FM text-based multiplex broadcast data. The ROM 22 and RAMs 23, 24 are connected to the CPU 21 via the system bus 29.

Figure 4:
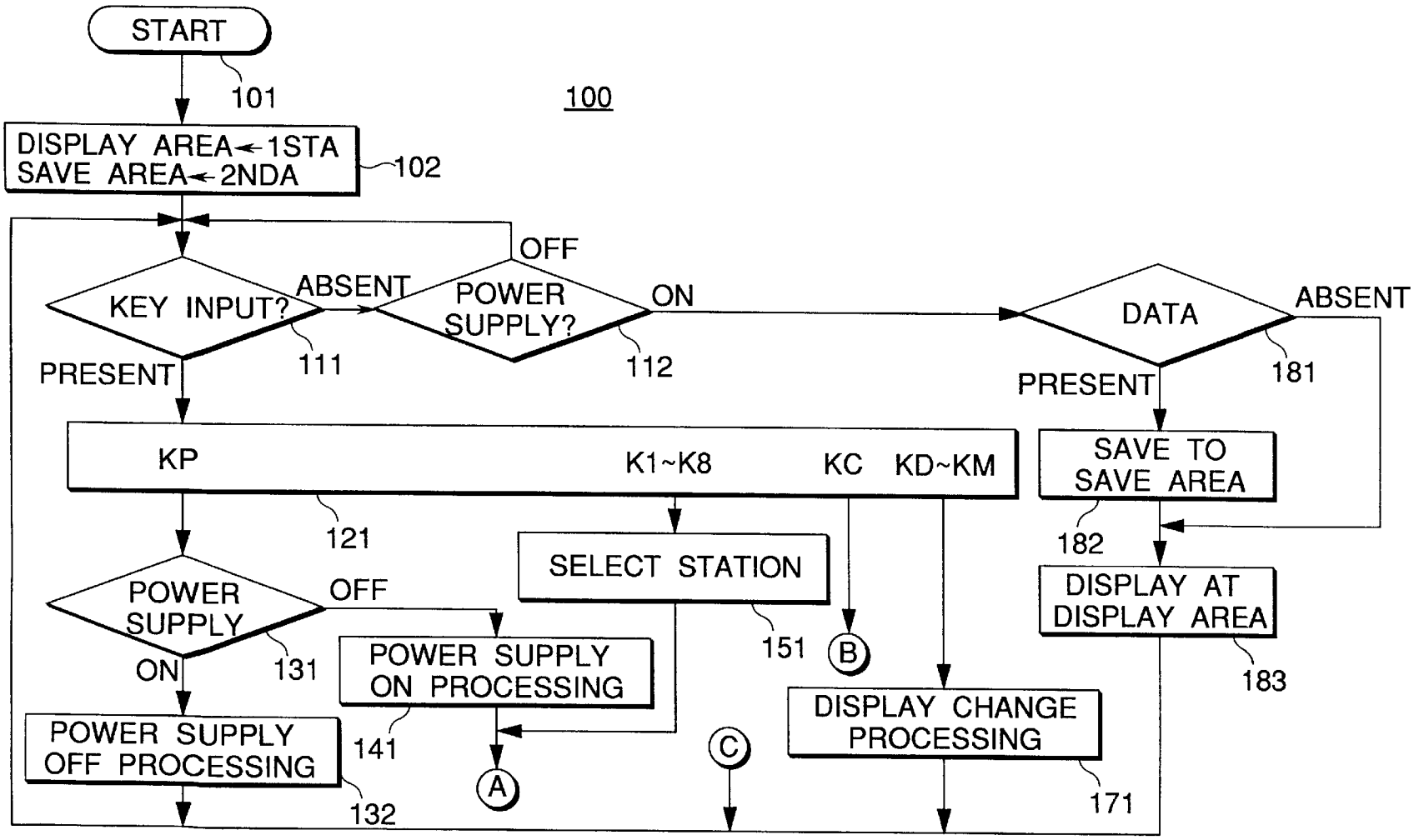
FIG. 4 is a flowchart showing part of the embodiment of the present invention.
Figure 5:
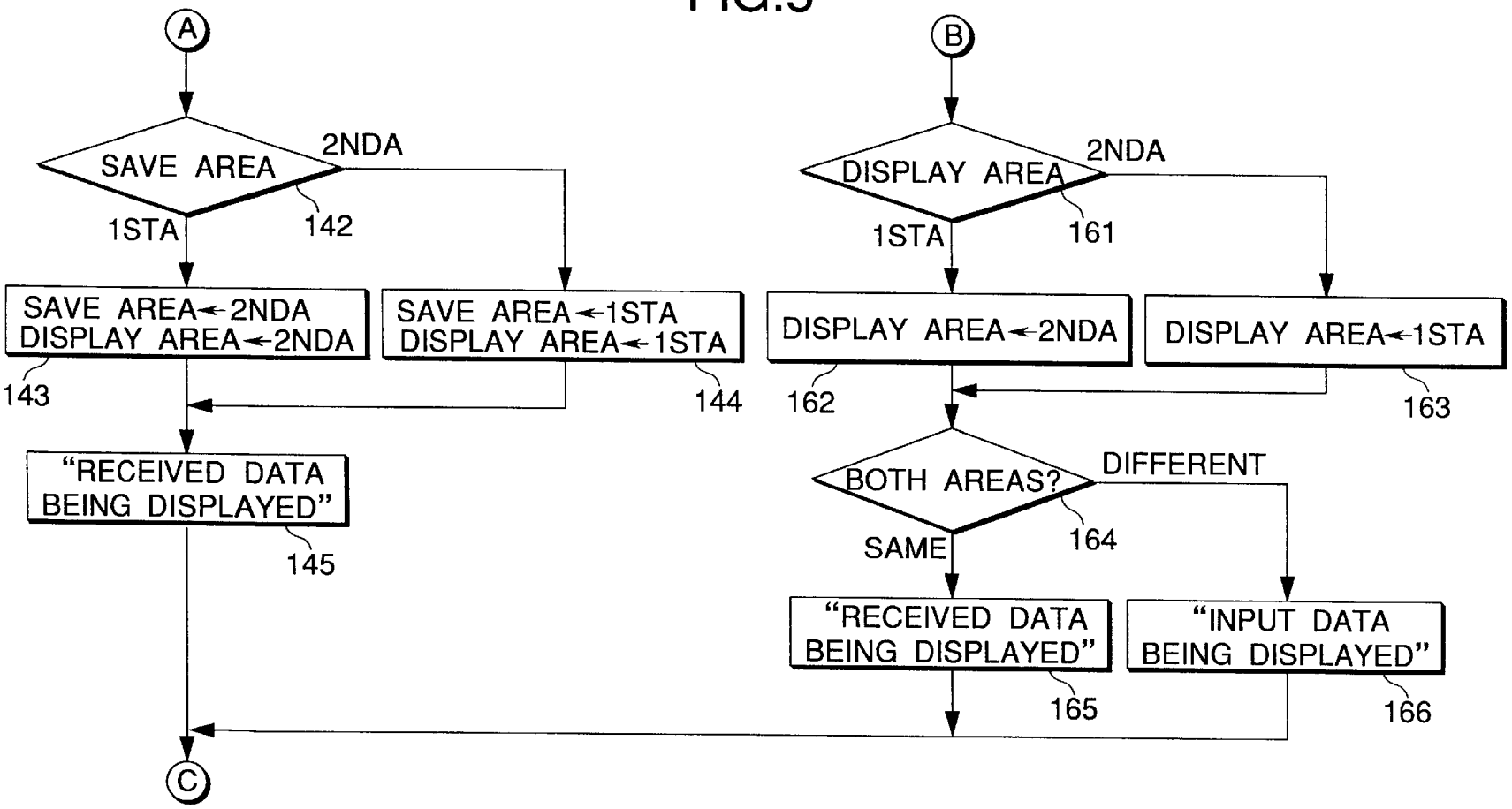
FIG. 5 is a flowchart showing a continuation of that of FIG. 3.

In this case, various programs are provided at the ROM 22 with, for example, the save/display routine 100 shown in FIG. 4 and FIG. 5 being provided. This routine 100 is for saving and displaying received text-based program data. The details of this routine are described later, but in the drawings, just portions relating to this invention are taken out and shown for simplicity.

The RAM 24 for use as a reception buffer for the character data is given a capacity for two broadcasting stations or two time zones. The area thereof is divided into the first area 1STA and the second area 2NDA. These areas 1STA and 2NDA are distinguished when used for displaying and saving of character data.

The body of the level 1 text-based multiplex broadcast is configured with 15.5 characters by two lines giving one page but in an actual text-based multiplex broadcast, the broadcasting station broadcasts text-based programs for 200 pages to 400 pages in all. A memory of one Megabit can store data for approximately 500 pages and it is therefore sufficient for the RAM 24 to have a memory capacity of 1 to 2 Mbits.

Further, ports 25 and 26, and an interface circuit 27 are connected to the system bus 29. Data for station selection is supplied to the tuner circuit 12 from the CPU 21 via the port 25 and this station selection is executed. Text-based program data from the decoder circuit 18 is then accumulated or stored at the RAM 24 as reception buffer via the port 26.

Cursor keys (up and down keys) KD and KU, a deciding key KE, a menu key KM, a display changeover key KC, a power supply key KP etc. and, for example, 8 station select keys K1 to K8 are connected to the interface circuit 27 as operation keys. These keys KD to K8 are non-locking type push-button switches.

Further, a font ROM (character generator) 31 for converting character data transmitted by the FM text-based multiplex broadcast into display data and a display controller 32 are connected to the system bus 29. A memory 33 for display is connected to the display controller 32 together with an LCD 50 as a display element.

In this case, the LCD 50 is made to adopt a full dot matrix system that displays characters using combinations of dots, and the display region thereof is made to have a size for, for example, two pages of level 1 text-based program as shown in FIG. 6A, i.e. 15.5 characters by 4.5 lines (248 dots wide by 72 dots high). The uppermost region of 0.5 line (8 dots high) of this display region is taken as a header region and the remaining 15.5 character by 4 line (64 dots high) region is taken as the main region for displaying the main body.

The memory 33 is made to adopt a bit map system in correspondence with the dot matrix system for the LCD 50 and has a capacity for one picture. The character code held in the RAM 24 for reception buffer or the character code provided beforehand at the ROM 22 is read out by the CPU 21. The read out character code is then converted to display data by using font data in the ROM 31 and this display data is written to the memory 33 via the display controller 32.

At this time, display data in the memory 33 is repeatedly read out by the display controller 32, converted to a display signal and supplied to the LCD 50. The LCD 50 then displays characters etc. in accordance with character code read out from the RAM 24 or the ROM 22 by the CPU 21.

Further, although not shown in the drawings the power supply for the receiver is alternately changed over between being on and off every time the power supply key KP is pressed. Because of this, the power supply system for this receiver is divided into, for example, a power supply system for the receiver circuit 10 and a power supply system for the microcomputer 20 so that an on-off control of the power supply system for the receiver circuit 10 is performed by the microcomputer 20. The microcomputer 20 can be switched over between a normal mode for normal operation and a wait mode for waiting for a key input with power consumption being kept to a minimum.

When the power supply for the receiver is on, the microcomputer 20 operates in normal mode and the power supply for the receiver circuit 10 is turned on. When the power supply for the receiver is off, the microcomputer 20 operates in wait mode and the power supply for the receiver circuit 10 is turned off.

In the above configuration, various kinds of processings such as displaying are executed by the procedures in the flowcharts of FIG. 4 and FIG. 5 as follows.

[Waiting for key input (when the power supply is off)]

When a battery is installed in the receiver or an AC adapter is connected to the receiver, the processing of the CPU 21 starts from step 101 of the routine 100. Next, in step 102, each part is initialized and the areas 1STA and 2NDA of the RAM 24 are provisionally set to "display area" and "save area", respectively. In this case, of the two areas 1STA and 2NDA of the RAM 24, the display area represents the area where the held character data is used for being displayed and the save area represents the area used for saving received character data.

The processing of the CPU 21 then proceeds to step S111 and a check is made as to whether one of the keys KD to K8 has been pressed. If none of these keys has been pressed, the processing proceeds from step 111 to step 112. In step 112, a determination is then made as to whether the power supply for the receiver is on or off, with the processing returning to step 111 when off.

Therefore, when the power supply for the receiver is off, steps 111 and 112 are repeated and a key input is awaited.

[When the power supply is on]

When the power supply key KP is pressed while steps 111 and 112 are repeated and a key input is awaited, this is detected in step 111 and the processing proceeds from step 111 to step 121. In step 121, the key detected in step 111 is determined. Since, in the current case, the pressed key is the power supply key KP, the processing then proceeds from step 121 to step 131.

In step 131, a determination is made as to whether the power supply for the receiver was on or off. In the current case, the power supply is off and the processing therefore proceeds from step 131 to step 141. In step 141, the power supply for the receiver is turned on together with a main menu of a text-based broadcast being set so that the main menu becomes the display target when the text-based broadcast can be received and is displayed.

In step 141, frequency data of last channel (frequency of the broadcasting station received the last time the power supply was turned off) is read from the RAM 23, this frequency data is supplied to the tuner circuit 12 via the port 25 and the received frequency of the tuner circuit 12 is set to the frequency expressed by the frequency data. In this way, the broadcasting station for the last channel is selected.

Next to this, the processing proceeds to step 142 and a determination is made as to which of the first area 1STA and the second area 2NDA the save area is set to. When the save area is set to the first area 1STA, the processing proceeds from step 142 to step 143, the save area and display area are set to the second area 2NDA, and the processing proceeds to step 145.

Further, in step 142, when the save area is set to the second area 2NDA, the processing proceeds from step 142 to step 144, the save area and the display area are set to the first area 1STA and the processing proceeds to step 145.

Therefore, when the power supply is turned on, of the areas 1STA and 2NDA, the save area for the character data is changed over from the area that has been used for saving up until this time to the area that has not been used, by the processings in steps 142 to 144. The character data for the area newly used in this saving is then becomes to be used for displaying.

Next to this, in step 145, prescribed data is supplied to the memory 33 and a character string of, for example, "received data being displayed" is displayed for three seconds at the LCD 50. The processing then returns to step 111 and the processing in [waiting for key input (when the power supply is on)] described below is executed.

Thus, if the power supply key KP is pressed when the power supply for the receiver is off, the power supply for the receiver is turned on and the broadcasting station for the last channel is selected. Of the areas 1STA and 2NDA, the area of the RAM 24 used in saving character data is then switched over from the area used in saving character data at the last turning on of the power supply to the area that was not used. The character data for the area newly used for saving is then set to be used in displaying.

[Waiting for a key input when the power supply is on]

When the processing returns to step 111 due to the aforementioned processing described in [when the power supply is on], the processing further proceeds to step 112. Since the power supply is on in this case, the processing then proceeds from step 112 to step 181 and a determination is made as to whether or not character data has been obtained from the decoder circuit 18.

When character data has been obtained, the processing proceeds from step 181 to step 182 and in this step 182, of the areas 1STA and 2NDA, the character data obtained from the decoder circuit 18 is written to the save area. Then, in step 183, character data is read out from a display area as one of the areas 1STA and 2NDA and supplied to the memory 33. The processing then returns to step 111 and the processing after step 111 is repeated.

Therefore, if a text-based broadcast can be received when the power supply for the receiver is on, this character data is successively stored at the area of the areas 1STA and 2NDA of the RAM 24 that was not used for saving character data the previous time the power supply was on. The text-based programs can then be displayed with this character data. A key input is also awaited at this time.

In step 181, however, when no text-based broadcast can be received even when the power supply for the receiver is on, the processing proceeds from step 181 to step 183. Therefore, in this case, of the areas 1STA and 2NDA of the RAM 24, the area that is to be taken as the area for storing character data when character broadcast can be received is taken as the display target. However, since no new character data is saved at this area that is taken as the display target, the character data received on the previous occasion is therefore used for displaying, i.e. the text-based program received on the previous occasion is displayed. A key input is also awaited at this time.

[Preset Station Selection]

When the power supply for the receiver is on (at this time, step 111, step 112 and step 181 onwards are being repeated), of the station select keys K1 to K8, if a station select key Km (where m is any of m=1 to 8, the same applies hereafter) preset to a target broadcasting station is pressed, this is detected by step 111 and the processing proceeds to step 121. However, since the key is the station select key Km in the current case, the processing proceeds from step 121 to step 151. In step 151, of the frequency data written in the RAM 23 at addresses Al to A8, the frequency data Nm at the address Am is read out which corresponds to the pressed key Km.

This read out frequency data Nm is supplied to the tuner circuit 12 via the port 25 and the receiving frequency of the tuner circuit 12 is set to a frequency expressed by the frequency data Nm. Namely, the broadcasting station preset to the station select key Km is selected and a receiving state for the selected broadcasting station is continued.

The processing of the CPU 21 then proceeds from step 151 to step 142 and the same processing as that for when the power supply is turned on is executed by step 142 to 145, with the processing then returning to step 111.

Therefore, by simply pressing the station select key Km, the broadcasting station preset to this key operation can be selected at once. As steps 142 to 145 are also executed in this case, if the selected broadcasting station carries out text-based broadcasting, the text-based program for this text-based broadcasting is saved and displayed.

Since the method for writing frequency data in the memory at addresses Al to A8 can be carried out in the same way as that for a general PLL synthesizing system receiver, a description is omitted here.

[Display switching]

This is the case of switching over between displaying the text-based program currently being received and the text-based program that was received on the previous occasion and saved. In this case, the changeover key KC is pressed when the power supply is on.

Pressing of the changeover key KC is detected at step 111 and the processing proceeds from step 111 to step 121. In this case, since the pressed key is the changeover key KC, the process proceeds from step 121 to step 161. In step 161 it is determined which of the first area 1STA and the second area 2NDA is set as the display area. When the display area is set to be the first area 1STA, the processing proceeds from step 161 to step 162. In step 162, the display area is set to be the second area 2NDA with the processing then proceeding to step 164 thereafter.

In step 161, when the display area is set to be the second area 2NDA, the processing proceeds from step 161 to step 163. The display area is then set to be the first area 1STA in step 163 and the processing then proceeds to step 164.

Therefore, when the display changeover key KC is pressed, of the areas 1STA and 2NDA, the display area is changed over from the area that has been used in displaying up to this time to the area that has not been used in displaying.

The processing then proceeds to step 164 and a determination is made as to whether the display area is the same area as the save area. When these areas are the same area the data being saved is to be used in displaying. The processing then proceeds from step 164 to step 165 and prescribed data is supplied to the memory 33. Then, a character string of, for example, "received data being displayed" is displayed for three seconds at the LCD 50 and the processing returns to step 111.

When the areas are not the same area in step 164, data saved on the previous occasion is used in displaying and the processing proceeds from step 164 to step 166. In step 166, prescribed data is supplied to the memory 33 and a character string of, for example, "data for previous time being displayed" is displayed at the LCD 50, with the processing then returning to step 111.

Displaying can be therefore carried out with the area 1STA and the area 2NDA of the RAM 24 being changed over therebetween each time the display changeover key KC is pressed.

[Displaying of text-based programs]

If a cursor key KD or KU, a deciding key KE or a menu key KM is pressed when a text-based program is being displayed at the LCD 50, this is detected in step 111 and the processing then proceeds from step 111 to step 121. Since the pressed key is the cursor key KD or KU, deciding key KE or the menu key KM in this case, the processing further proceeds from step 121 to step 171. In step 171 the display of the LCD 50 is changed in the way described in the following in accordance with the pressed key and the target text-based program is displayed. A description is given of an example of the case of displaying weather in Kanagawa area as shown in FIG. 6F, FIG. 7F and FIG. 6G, FIG. 7G.

Namely, when the power supply is turned on and the text-based broadcast is received, of the areas 1STA and 2NDA of RAM 24, character data is successively accumulated at the area that is set to be the save area. When a certain amount of data has been accumulated, or when from the operation keys KD to KR, the menu key KM is pressed, the first page onwards of the full content list is displayed at the LCD 50 across ten lines in the way shown, for example, in FIG. 6A and FIG. 7A in accordance with this accumulated character data. In the display, the first line of "1. PROGRAM INFORMATION" is enclosed by a rectangular frame that means a cursor.

When the down key KD is pressed, the position of displaying the cursor then changes from the state shown in FIG. 6A and FIG. 7A to those in FIGS. 6B, 6C . . . and FIGS. 7B, 7C . . . for each pressing so that the display of the full content list is scrolled. When the up key KU is pressed, the change becomes the reverse of that in the case when the down key KD is pressed.

The object in this case is to display the weather forecast so that, as shown for example in FIG. 6C and FIG. 7C, the deciding key KE is pressed when the cursor is positioned at the "3. WEATHER FORECAST". Then, as shown for example in FIG. 6D AND FIG. 7D, the first page onwards of the menu for "3. WEATHER FORECAST" is displayed with the cursor being displayed at the first line.

Here, the down key KD is further pressed again. Then, as shown for example, in FIG. 6E and FIG. 7E, the cursor is displayed at the second line of "WEATHER IN KANAGAWA AREA". When the deciding key KE is then pressed, as shown for example in FIG. 6F and FIG. 7F, the first page "<KANAGAWA AREA> (TODAY)" of "WEATHER IN KANAGAWA AREA" is displayed. When the down key KD is pressed again as necessary, "<KANAGAWA AREA> (TOMORROW)" of the second page is displayed as shown in FIG. 6G.

Since the displays of FIGS. 6F, 7F and FIGS. 6G, 7G is that of the object character information, the key operations relating to this display are completed. The display returns to a menu for a hierarchical layer that is one order higher when the menu key KM is pressed no matter which menu or which page is being displayed.

[Power Supply Off]

If the power supply key KP is pressed when the power supply is on, the pressing of the power supply key is detected by step 111 as described above, and the processing proceeds to step 131 from step 111 via step 121. Since the power supply is on in this case, the processing proceeds from step 131 to step 132.

In this step 132, the frequency data expressing the received frequency at this time is written into RAM 23 as the frequency data for the last channel for the next turning on of the power supply. The power supply of the receiver is then turned off, and the processing returns to step 111 to enter the state described in [Waiting for key input (when the power supply is off)].

According to the above receiver, two areas 1STA and 2NDA are provided at the RAM 24 with the area for storing received character data being changed over between the area 1STA and the area 2NDA every time the power supply is turned on, with character programs then being displayed with the character data in this save area. The most recent text-based broadcast being received can then be viewed when text-based broadcasts are received.

Also in the case that the station selection is changed with the station select keys K1 to K8, the saving and displaying of the received character data is executed in the same manner as at the time the power supply is turned on and text-based program of the broadcasting station after the station selection can be also viewed.

Even if a new text-based broadcast is received by turning the power supply on or by carrying out station selection, the previous character data has been saved and the previous text-based program can therefore be viewed with this previous character data. Further, since the previous text-based program can be displayed by pressing the display changeover key KC at this time, the saved text-based program cannot be mistaken for the text-based program for the current broadcast.

According to the present invention, the program of the most recent text-based broadcast that is being received can be viewed while receiving the text-based broadcast. Further, even when the selected broadcasting station is changed, the text-based program of the newly selected broadcasting station can be viewed. The previous text-based program can also be viewed. At this time, the saved text-based program cannot be mistaken for the text-based program currently being broadcast.

What is claimed is:

1. A receiver for receiving a text-based multiplex broadcast signal formed of a text-based program signal data multiplexed with an original audio broadcast program signal, said receiver comprising:

a receiver circuit for receiving said text-based multiplex broadcast signal;

a power supply;

a decoder circuit for extracting said text-based program data from said multiplexed broadcast signal received by said receiver circuit;

a plurality of operation keys;

a display element for displaying said text-based program data; and a controller including a first memory area and a second memory area, wherein said text-based program data extracted by said decoder is alternately written to said first and second memories each time said power supply is turned on, said text-based program data is read out from a selected one of said first and second memory areas that is written with said text-based program data when said power supply is turned on, said text-based program being displayed on said display element with said read out data from said selected one of said first and second memory areas; and said selected memory area where reading out of said text-based program data is carried out is alternately switched over between said first memory area and said second memory area upon a prescribed key operation from said plurality of operation keys.

2. The receiver for receiving a text-based multiplex broadcast signal of claim 1, wherein writing of said text-based program data is alternately switched between said first memory area and said second memory area each time a broadcast station is selected;

said text-based program data is read out from a memory area where said writing is being carried out; and said text-based program data is displayed on said display element with said read out data read from said memory area.

* * * * *